US008127474B2

(12) United States Patent
Phillips

(10) Patent No.: US 8,127,474 B2
(45) Date of Patent: Mar. 6, 2012

(54) DREDGING APPARATUS

(75) Inventor: Richard John Phillips, Crystal River, FL (US)

(73) Assignees: Richard John Phillips, Crystal River, FL (US); Cheryl F. Phillips, Crystal River, FL (US)

( * ) Notice: Subject to any disclaimer, the term of this patent is extended or adjusted under 35 U.S.C. 154(b) by 70 days.

(21) Appl. No.: 12/490,448

(22) Filed: Jun. 24, 2009

(65) Prior Publication Data

US 2010/0011627 A1 Jan. 21, 2010

(51) Int. Cl.
*E02F 9/10* (2006.01)

(52) U.S. Cl. ..... 37/334; 37/333; 37/311; 37/313

(58) Field of Classification Search ..... 37/307, 37/317, 334, 345, 309, 311, 313, 318, 320, 37/321, 322, 333, 335, 336
See application file for complete search history.

(56) References Cited

U.S. PATENT DOCUMENTS

| | | | | | |
|---|---|---|---|---|---|
| 566,473 | A * | 8/1896 | Robinson | 37/331 |
| 1,254,357 | A * | 1/1918 | Reid | 37/334 |
| 2,204,584 | A * | 6/1940 | Flower | 119/235 |
| 2,205,490 | A * | 6/1940 | Peterson | 37/308 |
| 3,152,409 | A * | 10/1964 | Ramsden et al. | 37/322 |
| 3,273,664 | A * | 9/1966 | Ramer | 180/400 |
| 3,521,387 | A * | 7/1970 | Degelman | 37/310 |
| 3,579,872 | A * | 5/1971 | Jantzen | 37/310 |
| 3,738,029 | A * | 6/1973 | Harmon | 37/329 |
| 3,755,932 | A * | 9/1973 | Cargile, Jr. | 37/331 |
| 3,919,790 | A * | 11/1975 | Sasaki et al. | 37/329 |
| 4,102,064 | A * | 7/1978 | Pot | 37/310 |
| 4,242,815 | A * | 1/1981 | Vermeulen | 37/308 |
| 4,267,652 | A * | 5/1981 | Senesac | 37/329 |
| 4,311,066 | A * | 1/1982 | Schuhmann | 475/76 |
| 4,311,342 | A * | 1/1982 | Latimer | 299/8 |
| 4,351,122 | A * | 9/1982 | Cornelis et al. | 37/308 |
| 4,352,250 | A * | 10/1982 | de Vries | 37/334 |
| 4,585,274 | A * | 4/1986 | Grable | 299/7 |
| 4,887,371 | A * | 12/1989 | Kaiser | 37/309 |
| 7,513,008 | B2 * | 4/2009 | Tucker | 15/320 |
| 7,721,472 | B2 * | 5/2010 | Buhr et al. | 37/317 |

OTHER PUBLICATIONS

Citrus County Chronicle, Local Resident Invents Aquatic "Muck Sucker", Dec. 5, 2007, viewed at http://www.chronicleonline.com.

Equipment Specialties Co., P20-Piranha Dredge (specification sheet), viewed at http://piranhapump.com/files/p20_manual.pdf on Jun. 23, 2009.

* cited by examiner

*Primary Examiner* — Robert Pezzuto
*Assistant Examiner* — Jamie L McGowan
(74) *Attorney, Agent, or Firm* — Law Office of Steven R. Olsen, PLLC; Steven R. Olsen

(57) ABSTRACT

In embodiments of the invention, a dredging head assembly uses vacuum only, or a combination of vacuum and flexible PVC tines, rather than the harsh digging and/or scraping features of conventional dredging equipment. Embodiments of the invention also provide a dredging head assembly that may be used in very shallow water. An embodiment of the invention includes a hose and wand to enable vacuuming around obstacles.

16 Claims, 11 Drawing Sheets

DREDGING APPARATUS

BACKGROUND

1. Field of the Invention

The invention relates generally to a dredging apparatus, and more specifically, but without limitation, to a dredging apparatus having a submersible head assembly that is configured to remove sludge and/or other matter from a waterway.

2. Description of the Related Art

Dredging is the process of removing bottom sediments or other matter from a body of water. Dredging may be performed in seas or in fresh water, for instance to improve navigation, for mining purposes, and/or for the remediation of contaminated waters.

Conventional dredging equipment is not effective in all conditions and applications, however. For example, most conventional dredges are configured to harshly scrape the bed of the waterway. This may be undesirable where fragile aquatic ecosystems could be damaged.

In addition, conventional dredging equipment that is adapted to remove sand or other sediments often suffer from clogged suction pumps and/or discharge lines in canals or other environments that contain a large amount of sludge. This is because sludge is more viscous than slurries of sand. Similar problems can arise when invasive plant life, trash, or other debris is being removed from a waterway.

Moreover, it is sometimes necessary to perform dredging operations in very shallow waters. For instance, it may be desirable to dredge at the edge of a lake, or in a shallow stream or pond. Target areas may also include obstacles such as docks, piers, or large boulders. Conventional dredging equipment generally cannot operate in such environments because the dredging boats cannot navigate in very shallow waters or through narrow passages.

For these and other reasons, improved dredging equipment is needed.

SUMMARY OF THE INVENTION

Embodiments of the invention seek to address one or more of the shortcomings described above with respect to conventional dredging equipment. In embodiments of the invention, a dredging head assembly uses vacuum only, or a combination of vacuum and flexible PVC tines, rather than the harsh digging and/or scraping features of conventional dredging equipment. Embodiments of the invention also provide a dredging head assembly that may be used in very shallow water. An embodiment of the invention includes a hose and wand to enable vacuuming around obstacles. One variant of the dredging head assembly is adapted for skimming floating debris from the surface of a body of water.

More specifically, one embodiment of the invention provides a dredging apparatus. The dredging apparatus includes: a hull; a boom coupled to the hull adjacent to an aft end of the boom; a winch coupled to the hull; a mast movably coupled to the boom and movably coupled to the hull, the mast having a pulley; a cable coupled to the winch, movably coupled to the pulley, and further coupled adjacent to a fore end of the boom; and a ram coupled to the hull and the boom, the dredging apparatus thus configured to raise and lower the boom using at least one of the winch and the ram.

Another embodiment of the invention provides a dredging head assembly. The dredging head assembly includes: a frame; a suction pump coupled to the frame; a hydraulic motor coupled to drive the suction pump; and a wheel assembly coupled to the frame.

BRIEF DESCRIPTION OF THE DRAWINGS

The invention will be more fully understood from the detailed description below and the accompanying drawings, wherein.

DETAILED DESCRIPTION

Figure 1:
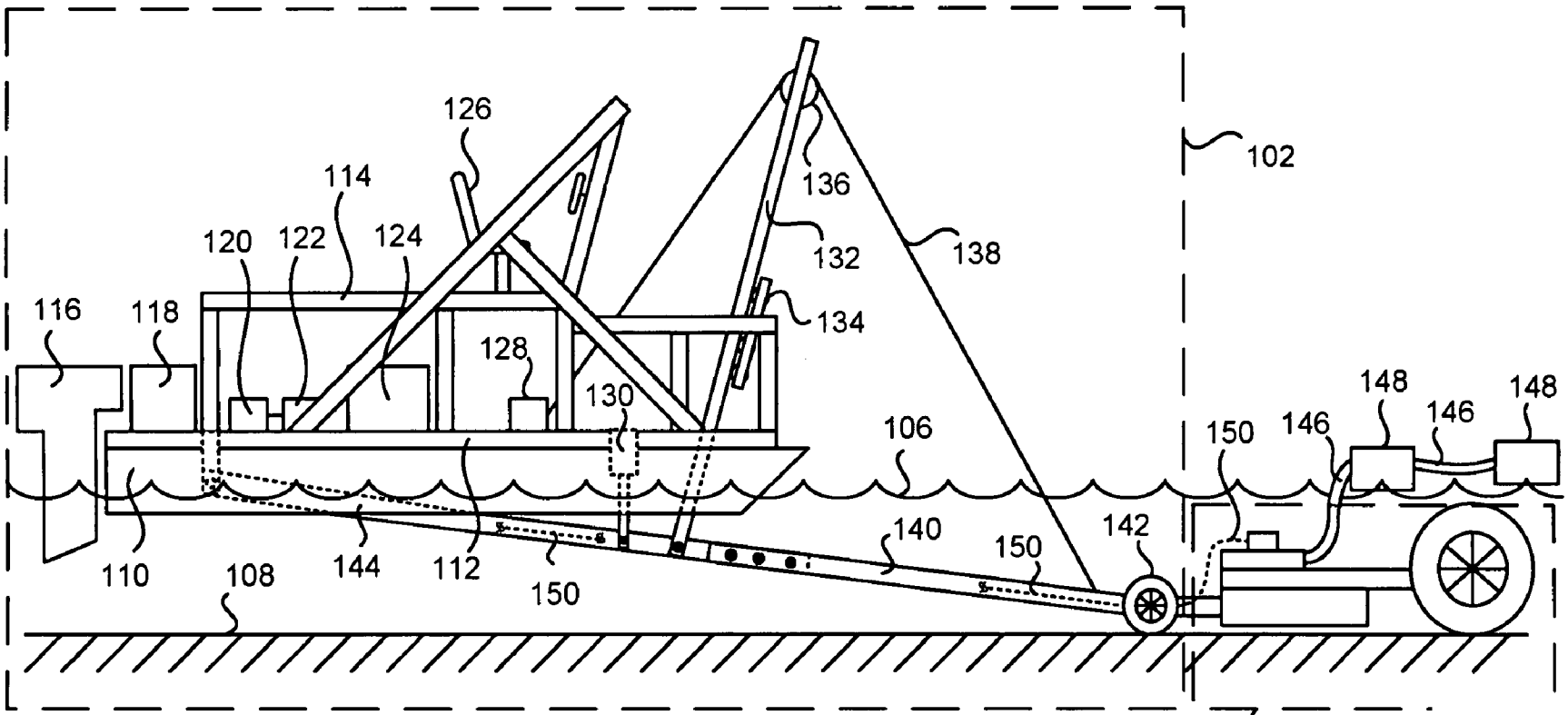
FIG. 1 is an elevation view of a dredging apparatus, according to an embodiment of the invention.

An embodiment of the invention will now be described more fully with reference to FIGS. 1 through 20. This invention may, however, be embodied in many different forms and should not be construed as limited to the embodiments set forth herein. In the drawings, reference designators may be duplicated for the same or similar features. The figures are not necessarily drawn to scale; some features may be exaggerated for clarity.

FIG. 1 is an elevation view of a dredging apparatus, according to an embodiment of the invention. As shown therein, a dredging boat 102 is coupled to a dredging head assembly 104. The dredging boat 102 and the dredging head assembly 104 are shown with respect to a water surface 106 and a floor 108. The floor 108 may be, for example, a lake, river, or stream bed.

In the illustrated embodiment, the dredging boat 102 includes a hull 110 that is topped by a lower deck 112. An outboard motor 116 is coupled to the hull 110. A hydraulic oil tank 118, hydraulic pump 120, gear box 122, gas engine 124, and cable winch 128 are mounted to the lower deck 112. The dredging boat 102 further includes an upper deck 114 disposed above the lower deck 112. A chair 126 is disposed on the upper deck 114.

The dredging boat 102 also includes a fore boom section 140 coupled to an aft boom section 144. The aft boom section 144 is further coupled at an aft portion of the hull 110. In addition, the aft boom section 144 is coupled to the hull 110 and/or the lower deck 112 via at least one hydraulic ram 130. As used herein, a ram is a mechanical device that produces pressure. The hydraulic ram 130 preferably produces pressure in two directions. A mast 132 is coupled to the aft boom section 144. The mast 132 is further coupled to the hull 110 via a skid plate 134. The mast 132 includes a pulley 136. A cable 138 is disposed from the cable winch 128 through the pulley 136 and to a forward section of the fore boom section 140. The fore boom section 140 additionally includes a wheel assembly 142 at a very leading edge. The wheel assembly 142 may include, for instance, 12 inch diameter tires.

Hydraulic lines 150 extend from the hydraulic pump 120 to the dredging head assembly 104. The hydraulic lines 150 may pass, for example, within or on the fore boom section 140 and the aft boom section 144. An outlet (discharge) pipe 146 extending from the dredging head assembly 104 may be disposed on the water surface 106 using one or more flotation devices 148.

The hull 110, lower deck 112, upper deck 114, and/or other components of the dredging boat 102 may be fabricated from aluminum to achieve a light weight and a shallow draft with respect to the water surface 106.

Variations to the configuration illustrated in FIG. 1 are possible. For instance, the placement of the hydraulic oil tank 118, hydraulic pump 120, gas engine 124, chair 126, and other components can be varied according to design choice. Multiple outboard motors 116 could be used. In addition, there are many variations with respect to the configuration of the dredging head assembly 104 that are described below with reference to FIGS. 7-20.

In operation, the dredging boat 102 moves the dredging head assembly 104 within a target dredging area using the outboard motor 116. In an alternative embodiment described with reference to FIGS. 12 and 13 below, the head assembly 104 may be self-propelled. In this instance, the outboard motor 116 may not be required during dredging operations, except perhaps to transport the dredging boat 102 and the dredging head assembly 104 to the target dredging area.

As illustrated in FIG. 1, the dredging head assembly 104 may be fully or partially submerged below the water surface 106 during operation. The fore boom section 140 permits the dredging head assembly 104 to roll on the floor 108, even in very shallow water.

FIGS. 2-5 show exemplary relative positions of the mast 132, fore boom section 140 and aft boom section 144 on the dredging boat 102.

Figure 2:
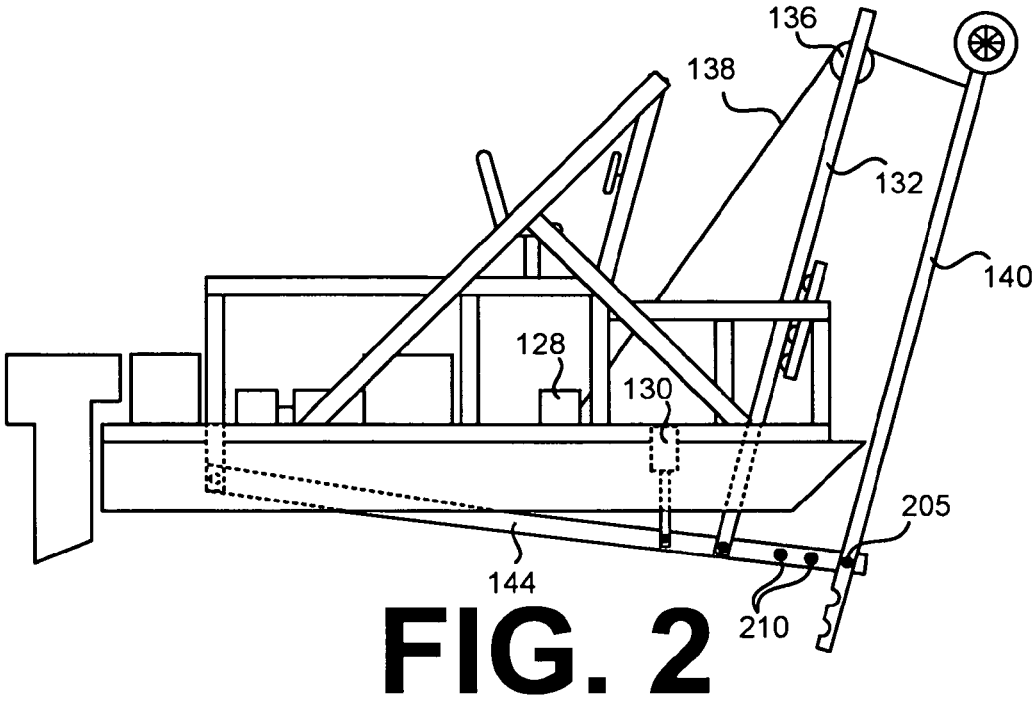
FIG. 2 is an elevation view of the dredging boat illustrated in FIG. 1.
Figure 4:
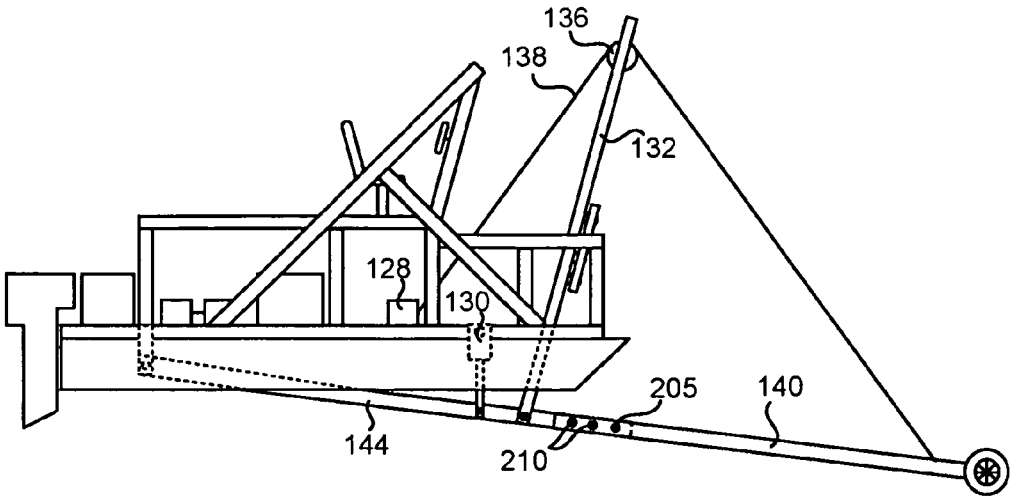
FIG. 4 is an elevation view of the dredging boat illustrated in FIG. 1.
Figure 5:
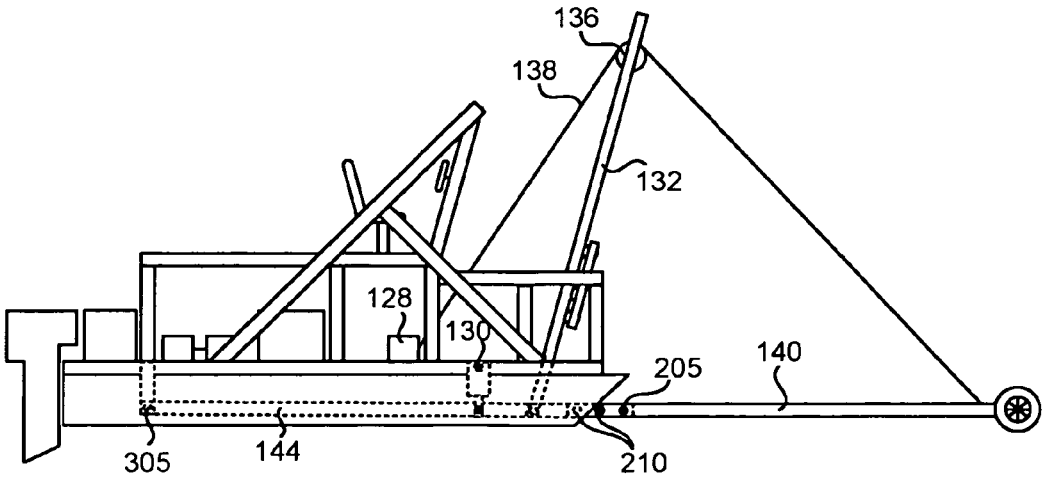
FIG. 5 is an elevation view of the dredging boat illustrated in FIG. 1.

FIG. 2 is an elevation view of the dredging boat illustrated in FIG. 1. In the configuration illustrated in FIG. 2, the fore boom section 140 is shown in a raised position. FIG. 2 also illustrates that the fore boom section 140 may be coupled to the aft boom section 144 at a fore boom pivot joint 205. Locking bars 210 may be used to limit the rotational position of the fore boom section 140 with respect to the aft boom section 144 (as illustrated in FIGS. 4 and 5). In operation, the fore boom section 140 may be moved to the illustrated raised position by retracting a relatively large amount of the cable 138 using the cable winch 128.

Figure 3:
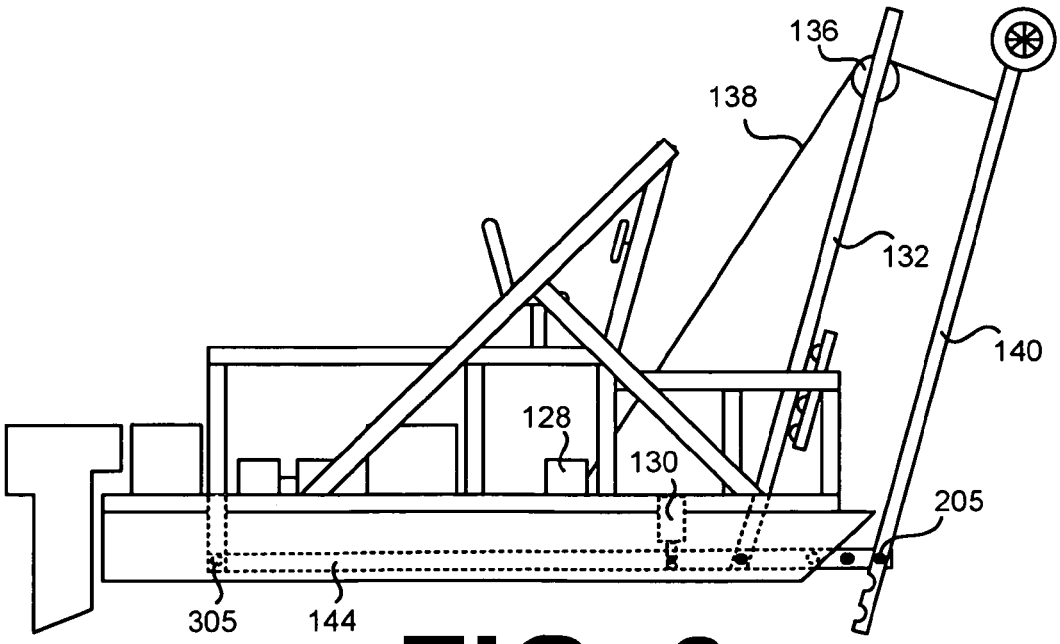
FIG. 3 is an elevation view of the dredging boat illustrated in FIG. 1.

FIG. 3 is an elevation view of the dredging boat illustrated in FIG. 1. As shown in FIG. 3, in a second position, the aft boom section 144 may be rotated about the aft boom pivot joint 305. In operation, the rotational position of the aft boom section 144 is controlled using the hydraulic ram 130. For instance, to transition from the position shown in FIG. 2 to the position shown in FIG. 3, the hydraulic ram 130 is compressed.

FIG. 4 is an elevation view of the dredging boat illustrated in FIG. 1. As illustrated in FIG. 4, the fore boom section 140 may be placed in a lowered position. In the illustrated configuration, the fore boom section 140 is coupled to the aft boom section 144 via fore boom pivot joint 205. The locking bars 210 prevent the fore boom section 140 from overextending with respect to the aft boom section 144. To extend the fore boom section 140, for instance from the position shown in FIG. 2 to the position shown in FIG. 4, the cable winch 128 releases an additional length of cable 138.

FIG. 5 is an elevation view of the dredging boat illustrated in FIG. 1. As illustrated in FIG. 5, the fore boom section 140 may be disposed in a lowered position and the aft boom section 144 may be disposed in a horizontal position. To transition from the position shown in FIG. 4 to the position shown in FIG. 5, the hydraulic ram 130 is compressed and a relatively small amount of cable 138 is retracted by the cable winch 128.

Figure 6:
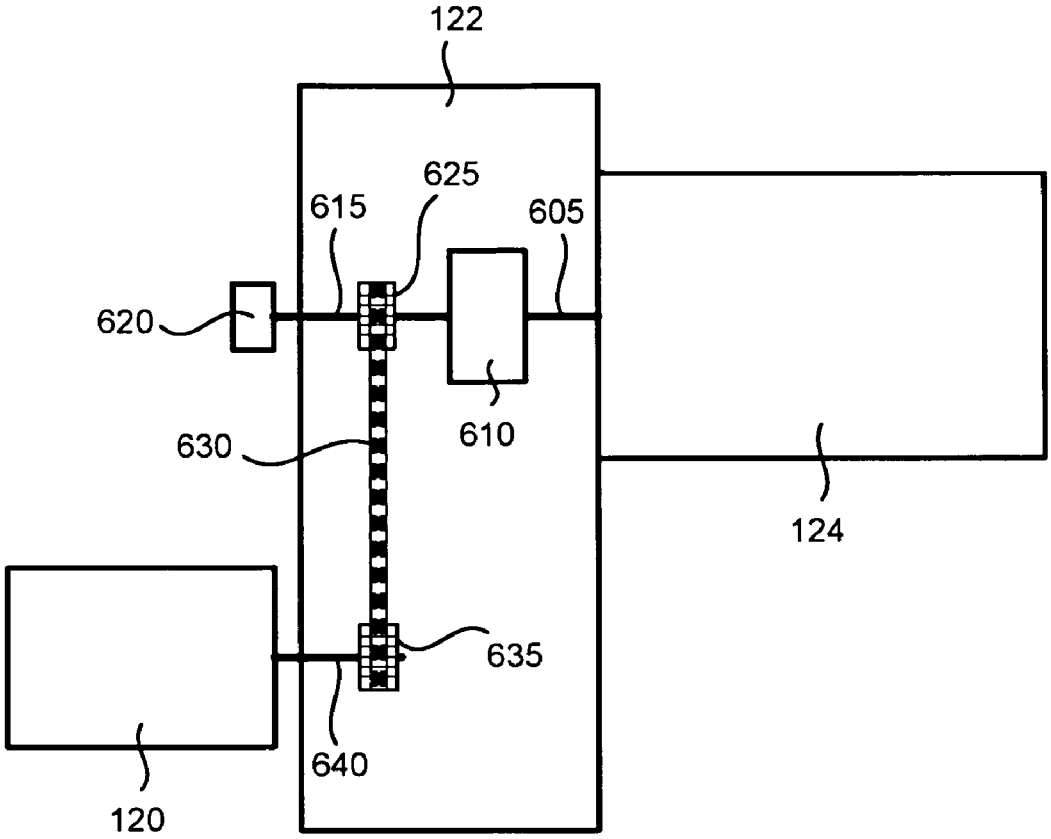
FIG. 6 is a plan view of a hydraulic fluid pumping system, according to an embodiment of the invention.

FIG. 6 is a plan view of a hydraulic fluid pumping system, according to an embodiment of the invention. As shown therein, the gas engine 124 is coupled to the hydraulic pump 120 via a gear box 122. The gas engine 124 may be or include, for instance, a conventional 4-cylinder or 6-cylinder engine. The gear box 122 includes a centrifugal clutch assembly 610. The gear box 122 may provide mechanical support for a rear portion of the engine 124. The gear box 122 may be oil-cooled. A drive shaft 605 couples the gas engine 124 to the centrifugal clutch assembly 610.

The centrifugal clutch assembly 610 is also coupled to a driven shaft 615. A first gear (sprocket) 625 is affixed to the driven shaft 615. The driven shaft 615 terminates at a carrier bearing assembly 620. The carrier bearing assembly 620 may be or include, for example, a pillow block bearing. The hydraulic pump 120 includes a hydraulic pump shaft 640 that has a second gear (sprocket) 635 affixed. A chain 630 is coupled between the first gear 625 and the second gear 635. The chain 630 may be, for example, an American National Standards Institute (ANSI) no. 60 roller chain. The first gear 625 and the second gear 635 need not have the same dimensions. For instance, the first gear 625 may be a 12-tooth gear, and the second gear 635 may be a 24-tooth gear. Other gearing could be used to achieve a desired gear ratio.

In operation, the gas engine 124 rotates the drive shaft 605. When the drive shaft 605 reaches a predetermined rotational speed (e.g., 1500 rpm), the centrifugal clutch assembly 610 engages the driven shaft 615. In turn, the driven shaft 615 rotates the hydraulic pump shaft 640 via the chain 630. The application of the centrifugal clutch assembly 610 may be advantageous because the load of the hydraulic pump 120 is not present when the gas engine 124 is started. The hydraulic pump 120 operates so long as the drive shaft 605 exceeds the predetermined rotational speed.

Variations to the configuration illustrated in FIG. 6 and described above are possible. For instance, the gas engine 124 could be replaced by a diesel-powered engine, a steam-powered engine, or another type of prime mover, according to design choice. In an alternative embodiment, the chain 630, first gear 625, and second gear 635 could be replaced by a drive shaft, belt and pulley system, or other means of power transmission.

Figure 7:
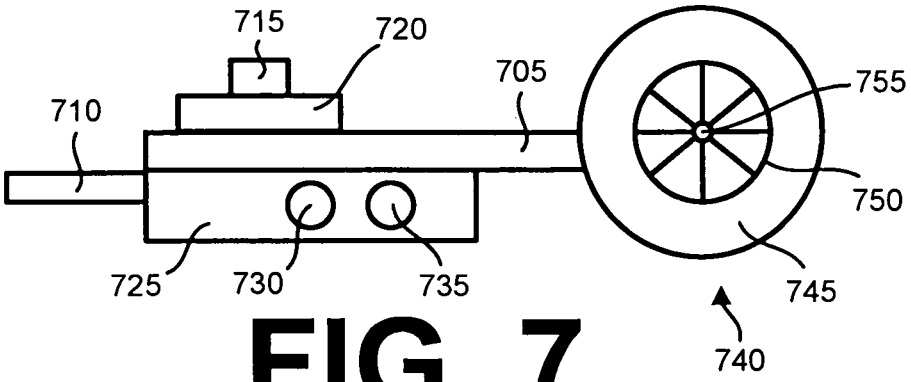
FIG. 7 is an elevation view of a dredging head assembly, according to an embodiment of the invention.

FIG. 7 is an elevation view of a dredging head assembly, according to an embodiment of the invention. The dredging head assembly illustrated in FIG. 7 may be, for instance, the dredging head assembly 104 that is shown in FIG. 1. The illustrated dredging head assembly 104 includes a head frame 705. A head coupling 710 is attached to the head frame 705. The head coupling 710 is configured to couple the dredging head assembly 104 to the dredging boat 102.

The illustrated dredging head assembly 104 further includes a hydraulic motor 715 that drives a suction pump 720. The suction pump 720 may have the capacity, for instance, to pump 900 gallons per minute (GPM). In addition, the dredging head assembly 104 that is illustrated in FIG. 7 includes a vacuum port 730 and a pressure relief valve 735 coupled to an intake wall 725. A forward portion of the dredging head assembly 104 includes a wheel assembly 740. The wheel assembly 740 includes a wheel 750 disposed on an axle 755. The wheel 750 is fitted with a tire 745. The tire 745 may be, for example, 22 inches in diameter.

Variations to the configuration illustrated in FIG. 7 and described above are possible. For instance, the vacuum port 730 and pressure relief valve 735 are each optional features. In alternative embodiments, there may be multiple suction pumps 720, each having an associated hydraulic motor 715. 2-pump and 3-pump variants are expressly described below. There may be more than one wheel assemblies 740 for each dredging head assembly 104.

Figure 8:
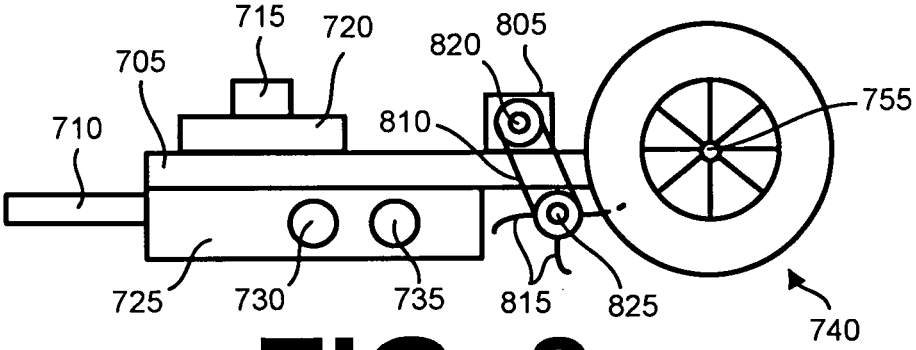
FIG. 8 is an elevation view of a dredging head assembly, according to an embodiment of the invention.

FIG. 8 is an elevation view of a dredging head assembly, according to another embodiment of the invention. As illustrated in FIG. 8, the dredging head assembly 104 may further include a beater bar motor 805. The beater bar motor 805 may be variable speed, and may be capable of both forward and reverse operation. A first sprocket 820 is affixed to a shaft of the beater bar motor 805. A second sprocket 825 is affixed to a beater bar (not shown in FIG. 8). A roller chain 810 is coupled between the first sprocket 820 and the second sprocket 825. Tines 815 are coupled to the beater bar. The tines 815 may be fabricated, for instance, from hollow, flexible, ⅝ inch diameter, polyvinyl chloride (PVC). In operation, the beater bar motor 805 rotates the tines 815 to soften the floor 108.

Figure 9:
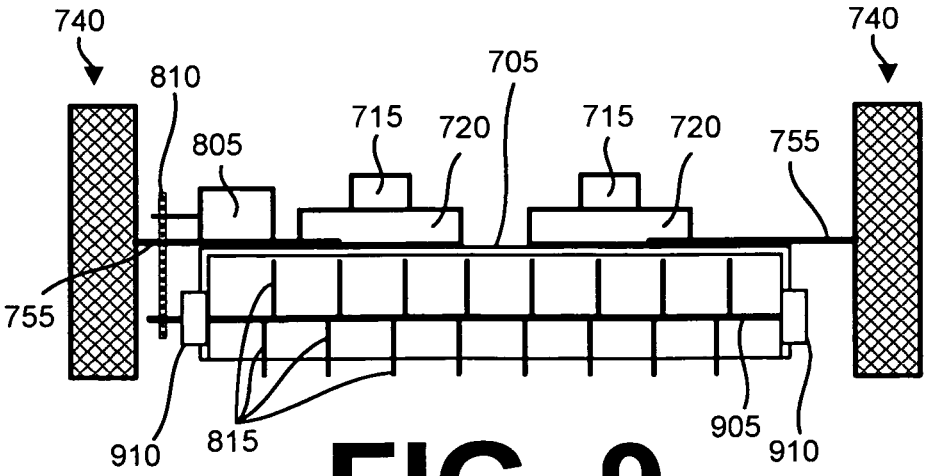
FIG. 9 is a front elevation view of the dredging head assembly in FIG. 8.

FIG. 9 is a front elevation view of the dredging head assembly in FIG. 8. As illustrated in FIG. 9, the dredging head assembly 104 may include two suction pumps 720, each driven by a corresponding hydraulic motor 715. FIG. 9 further illustrates that the tines 815 are attached to a beater bar 905. The beater bar 905 may be, for example, a ¼ inch diameter steel rod. To support the beater bar 905, the dredging head assembly 104 may further include a carrier bearing assembly 910 at or near each end of the beater bar 905. The carrier bearing assemblies 910 may be or include, for example, a pillow block bearing. In the embodiment illustrated in FIG. 9, each of two wheel assemblies 740 are coupled to the head frame 705 via a corresponding axle 755.

Variations to the embodiment illustrated in FIGS. 8 and 9 are possible. For instance, the dredging head assembly 104 may include a single suction pump 720 and associated hydraulic motor 715. In other embodiments, the dredging head assembly 104 may include more than two suction pumps 720 and associated hydraulic motors 715. In addition, there may be a fewer or greater number of tines 815 affixed to the beater bar 905, according to design choice. In an alternative embodiment, the roller chain 810, first sprocket 820, and second sprocket 825 could be replaced by a drive shaft, belt and pulley system, or other means of power transmission. The two axles 755 could be replaced by a single continuous axle that supports the two wheel assemblies 740.

Figure 10:
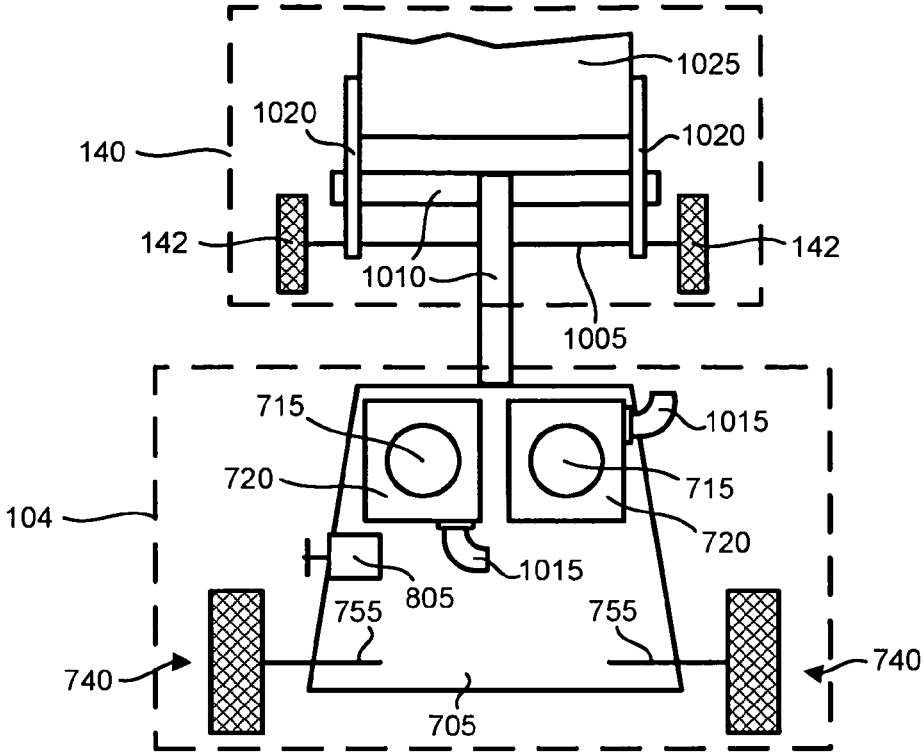
FIG. 10 is a plan view of a dredging head assembly, according to an embodiment of the invention.

FIG. 10 is a plan view of a dredging head assembly, according to an embodiment of the invention. As shown therein, the dredging head assembly 104 is coupled to a fore boom section 140 via a boom coupling 1010. The boom coupling 1010 may be configured, for example, to pivot where the boom coupling 1010 communicates with frame members 1020. Only a portion of the fore boom section 140 is shown in FIG. 10. The fore boom section 140 includes a plank 1025. The fore boom section 140 also has two wheel assemblies 142 that are disposed on a boom axle 1005. The dredging head assembly 104 shown in FIG. 10 includes two suction pumps 720, each being driven by an associated hydraulic motor 715. Each of the suction pumps 720 has an outlet port 1015. The outlet ports 1015 may be, for instance, 4 inches in diameter.

Embodiments with 900 GPM suction pumps 720 and 4 inch diameter outlet ports 1015 will resist clogging in many dredging environments.

Figure 11:
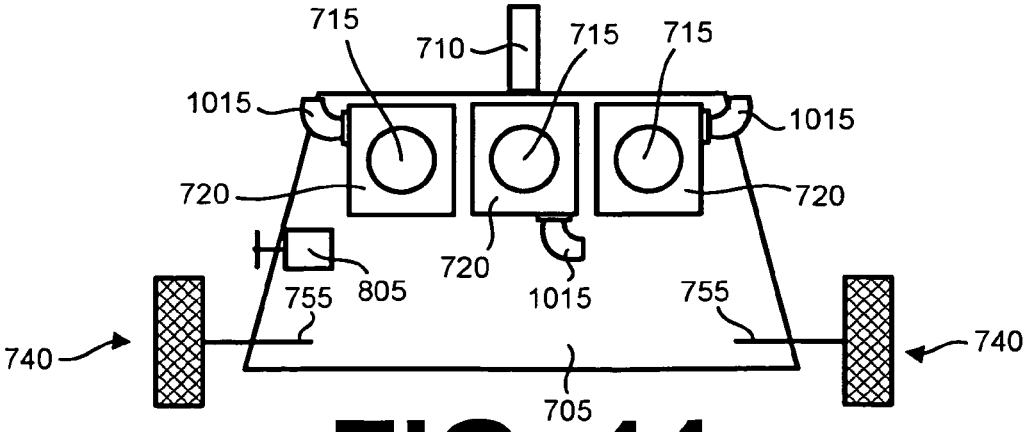
FIG. 11 is a plan view of a dredging head assembly, according to an embodiment of the invention.

FIG. 11 is a plan view of a dredging head assembly, according to an embodiment of the invention. As shown therein, an alternative embodiment of the dredging head assembly 104 includes three suction pumps 720, each of the suction pumps 720 being driven by a corresponding hydraulic motor 715.

The embodiments illustrated in FIGS. 12 and 13 and discussed below present two exemplary alternatives for a self-propelled dredging head assembly. The self-propelled dredging head assembly may eliminate the need for operation of the outboard motor 116 during dredging operations. This may be advantageous because the outboard motor 116 can create undesirable turbulence.

Figure 12:
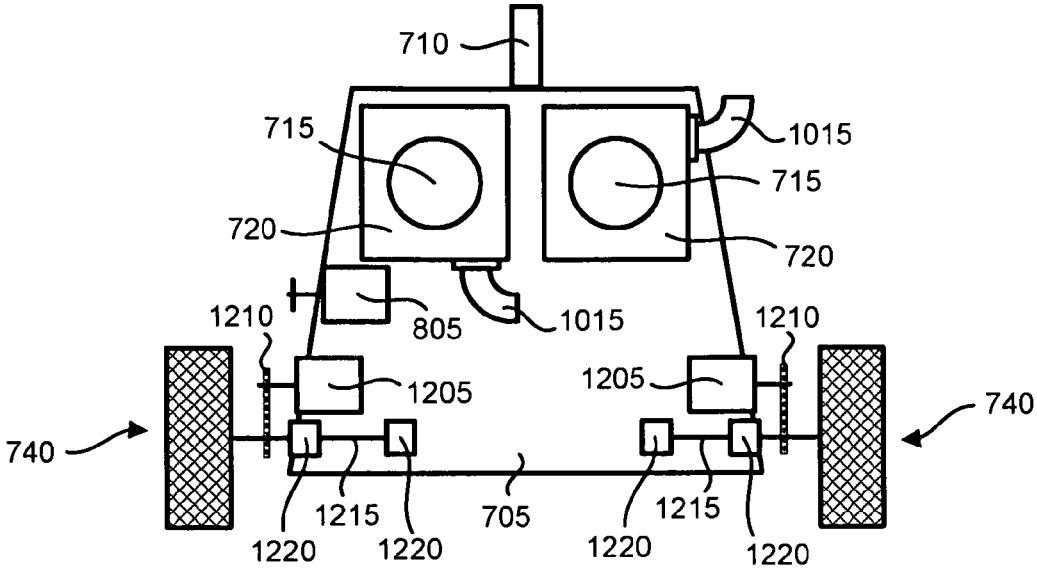
FIG. 12 is a plan view of a dredging head assembly, according to an embodiment of the invention.

FIG. 12 is a plan view of a dredging head assembly, according to an embodiment of the invention. As shown therein, the dredging head assembly 104 includes two drive motors 1205, each coupled to a corresponding drive shaft 1215 via a roller chain 1210 and sprockets (not shown). Each of the drive shafts 1215 may also be coupled to one or more carrier bearing assemblies 1220. The carrier bearing assemblies 1220 may be or include, for example, a pillow block bearing. The drive motors 1205 may be variable speed, and may have forward and reverse capability. In operation, the drive motors 1205 can be used to propel the dredging head assembly 104. In addition, differential steering can be accomplished by changing the rate of one drive motor 1205 with respect to the other.

Figure 13:
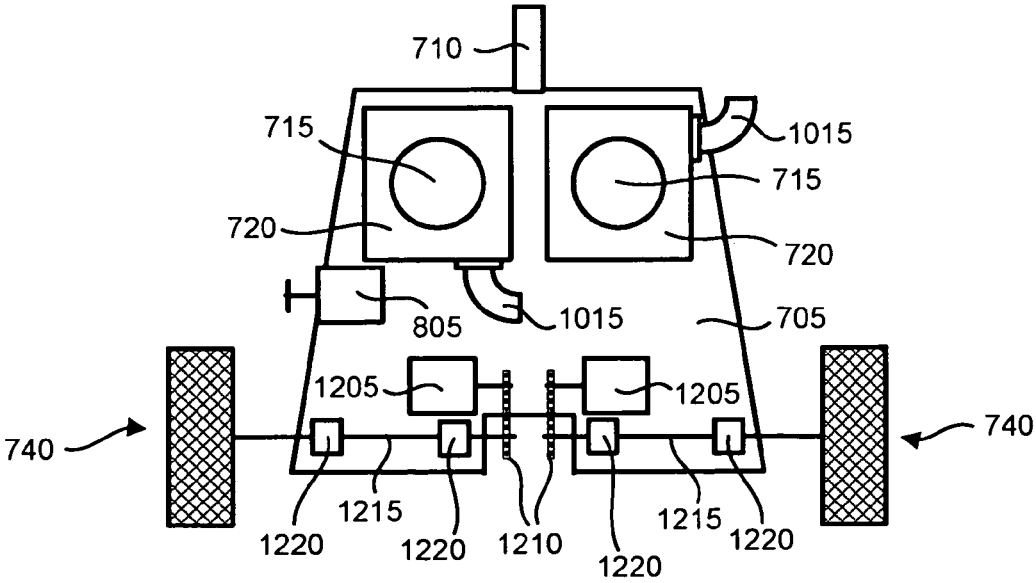
FIG. 13 is a plan view of a dredging head assembly, according to an embodiment of the invention.

FIG. 13 is a plan view of a dredging head assembly, according to an embodiment of the invention. The dredging head assembly 104 may also include drive motors 1205 coupled to drive shafts 1215 via roller chains 1210 and sprockets (not shown). In the embodiment illustrated in FIG. 13, however, the drive motors 1205 are disposed near a center portion of the head frame 705.

Figure 14:
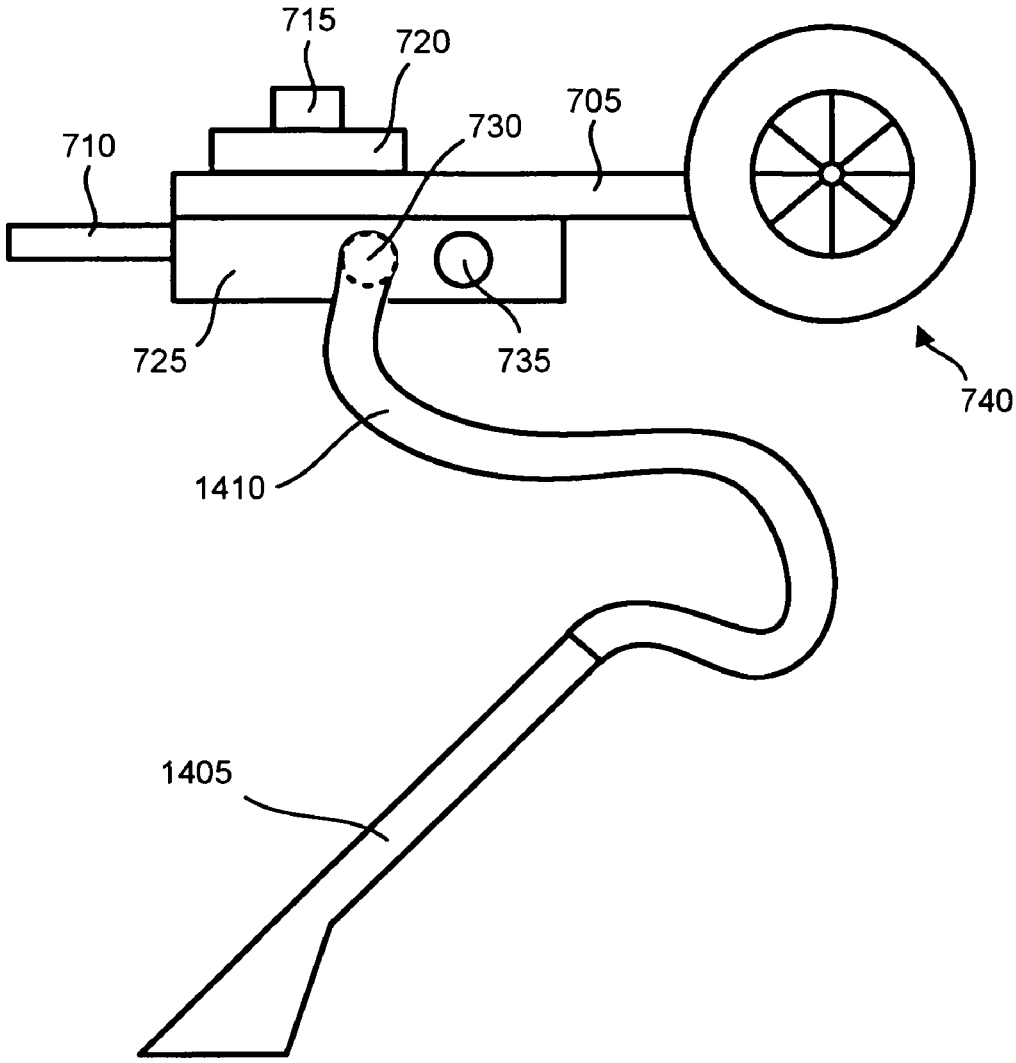
FIG. 14 is an elevation view of a dredging head assembly, according to an embodiment of the invention.

FIG. 14 is an elevation view of a dredging head assembly, according to an embodiment of the invention. In the illustrated embodiment, a flexible vacuum hose 1410 is coupled to an intake wall 725. The flexible vacuum hose 1410 may be, for example, 2 inches in diameter and 30 foot in length. A rigid wand 1405 may be coupled to an opposite end of the flexible vacuum hose 1410. In operation, the suction pump 720 creates a vacuum within the dredging head assembly 104 and further allows suction at the rigid wand 1405. An advantage of an embodiment that includes the flexible vacuum hose 1410 and rigid wand 1405 is that a human operator can easily vacuum around docks, large rocks, or other obstacles. Certain features of this embodiment are further described with respect to FIGS. 16 and 17 below.

Figure 15:
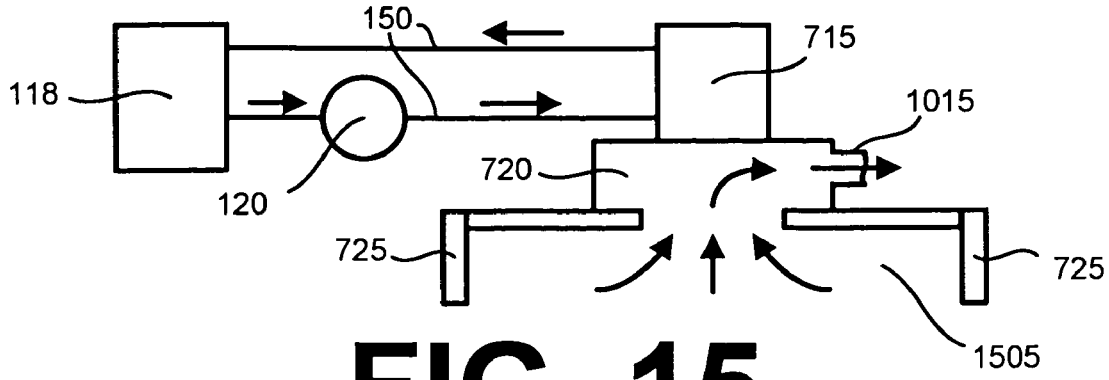
FIG. 15 is a fluid flow diagram of a dredging head assembly, according to embodiments of the invention.

FIG. 15 is a fluid flow diagram of a dredging head assembly, according to embodiments of the invention. As shown therein, the hydraulic pump 120 is configured to transfer oil from the hydraulic oil tank 118 to the hydraulic motor 715 via the hydraulic lines 150. The hydraulic lines 150 are also coupled to return oil from the hydraulic motor 715 to the hydraulic oil tank 118 on a return path. The hydraulic motor 715 drives the suction pump 720. An input port of the suction pump 720 is surrounded by an intake wall 725. The intake wall 725 forms an intake chamber 1505. During operation of the suction pump 720, water and particulates enter the intake chamber 1505, flow through the suction pump 720, and are expelled from the outlet port 1015. In alternative embodiments, the hydraulic pump 120 may drive multiple hydraulic motors 715.

Figure 16:
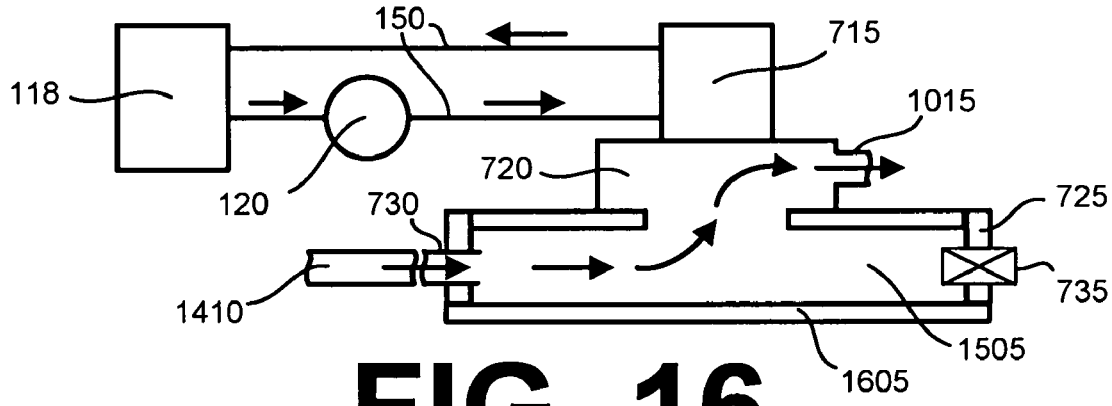
FIG. 16 is a fluid flow diagram for the dredging head assembly in FIG. 14.

FIG. 16 is a fluid flow diagram for the dredging head assembly in FIG. 14. As shown therein, the hydraulic pump 120 is configured to transfer oil from the hydraulic oil tank 118 to the hydraulic motor 715 via the hydraulic lines 150. The hydraulic lines 150 are also coupled to return oil from the hydraulic motor 715 to the hydraulic oil tank 118 on a return path. The hydraulic motor 715 drives the suction pump 720.

As also illustrated in FIG. 16, the intake chamber 1505 may be fully enclosed with the addition of the pan 1605. The vacuum hose 1410 is coupled to the vacuum port 730 in a portion of the intake wall 725. Fluid received into the vacuum hose 1410 flows through the intake chamber 1505 and the suction pump 720, and is expelled through the outlet port 1015.

Figure 17:
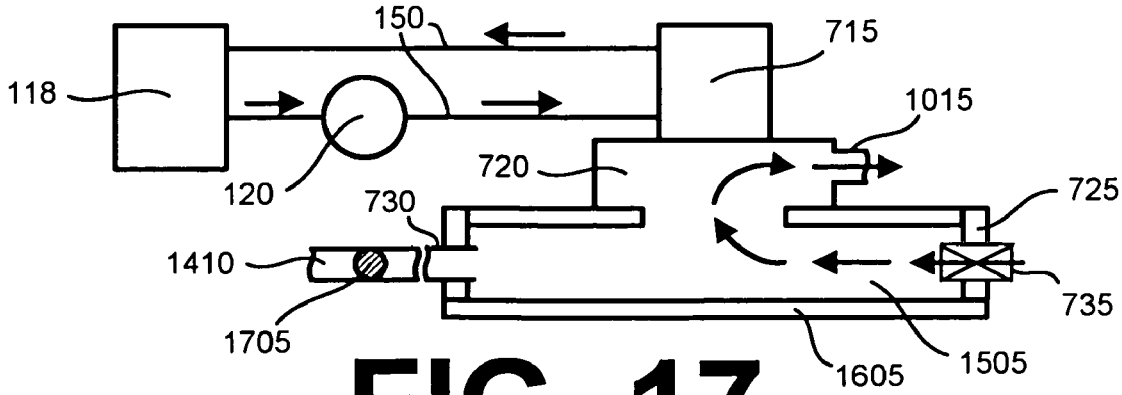
FIG. 17 is a fluid flow diagram for the dredging head assembly in FIG. 14.

FIG. 17 is a fluid flow diagram for the dredging head assembly in FIG. 14. As shown therein, the hydraulic pump 120 is configured to transfer oil from the hydraulic oil tank 118 to the hydraulic motor 715 via the hydraulic lines 150. The hydraulic lines 150 are also coupled to return oil from the hydraulic motor 715 to the hydraulic oil tank 118 on a return path. The hydraulic motor 715 drives the suction pump 720.

As also illustrated in FIG. 17, a pressure relief valve 735 is disposed in the intake wall 725. In the illustrated condition, the vacuum hose 1410 is at least partially clogged with an obstruction 1705 that restricts fluid flow through the vacuum port 730. When the intake chamber 1505 reaches a predetermined negative pressure, the pressure relief valve 735 opens. This allows fluid to flow through the pressure relief valve 735, through the suction pump 720, and out the outlet port 1015.

Figure 18A:
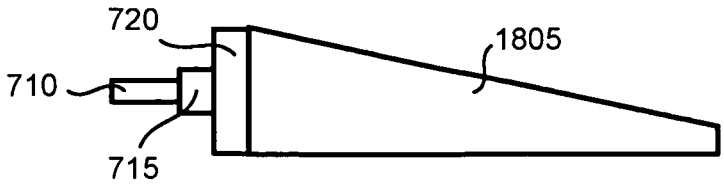
FIG. 18A is a side elevation view of a skimmer dredging head assembly, according to an embodiment of the invention.

FIG. 18A is a side elevation view of a skimmer dredging head assembly, according to an embodiment of the invention. As shown therein, a channel 1805 is coupled to a suction pump 720. The channel 1805 may be fabricated, for example, from a ⅜ inch thick sheet of aluminum. A hydraulic motor 715 drives the suction pump 720. The dredging head assembly illustrated in FIG. 18A can be coupled to, for example, the fore boom section 140 via the head coupling 710. The fore boom section 140 may suspend the skimmer dredging assembly at or near the water surface 106.

Figure 18B:
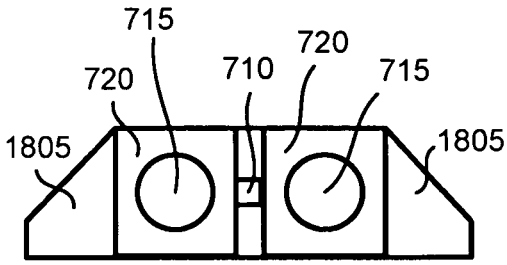
FIG. 18B is a rear elevation view of the skimmer dredging head assembly in FIG. 18A.
Figure 18C:
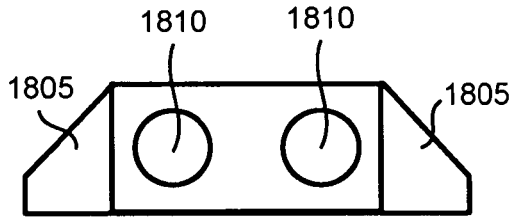
FIG. 18C is a front elevation view of the skimmer dredging head assembly in FIG. 18A.
Figure 18D:
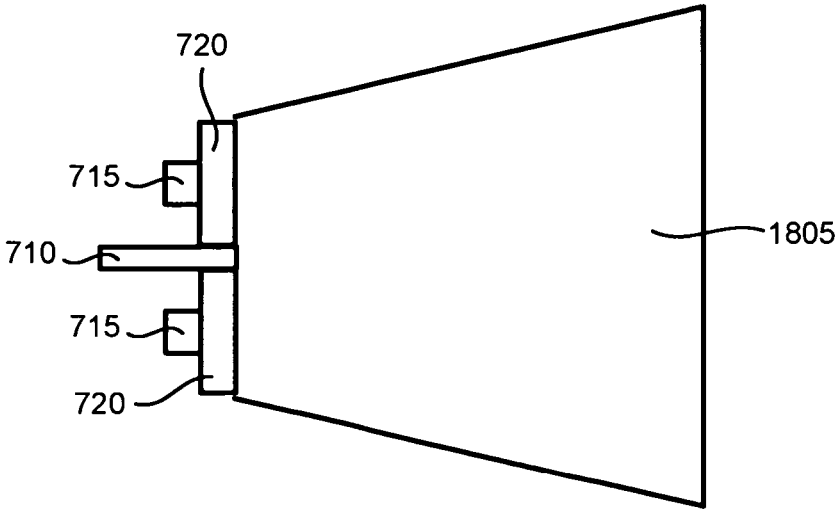
FIG. 18D is a plan view of the skimmer dredging head assembly in FIG. 18A.
Figure 18E:
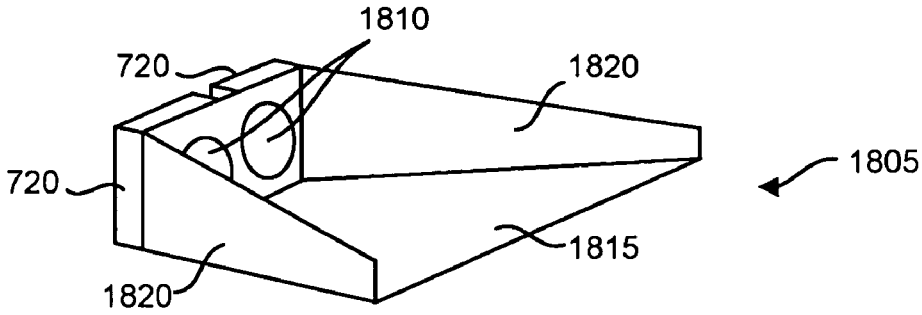
FIG. 18E is a perspective view of the skimmer dredging head assembly in FIG. 18A.

FIG. 18B is a rear elevation view of the skimmer dredging head assembly in FIG. 18A. FIG. 18B reveals that the skimmer dredging head assembly may include two suction pumps 720, each driven by a corresponding hydraulic motor 715. FIG. 18C is a front elevation view of the skimmer dredging head assembly in FIG. 18A. The frontal view shows two suction pump inlet ports 1810. In use, a plane that includes the mouth of the suction pump inlet ports 1810 is disposed at approximately 90 degrees with respect to a plane of the water surface 106. FIG. 18D is a plan view of the skimmer dredging head assembly in FIG. 18A. As shown in FIG. 18D, a footprint of the channel 1805 may be an isosceles trapezoid. FIG. 18E is a perspective view of the skimmer dredging head assembly in FIG. 18A. As illustrated in FIG. 18E, a channel floor 1815 may extend to the end of the channel walls 1820. A plane that includes the mouth of the suction pump inlet ports 1810 is disposed at approximately 90 degrees with respect to the channel floor 1815. In use, a plane that includes the channel floor 1810 is disposed approximately parallel to a plane that includes that water surface 106.

Figure 19:
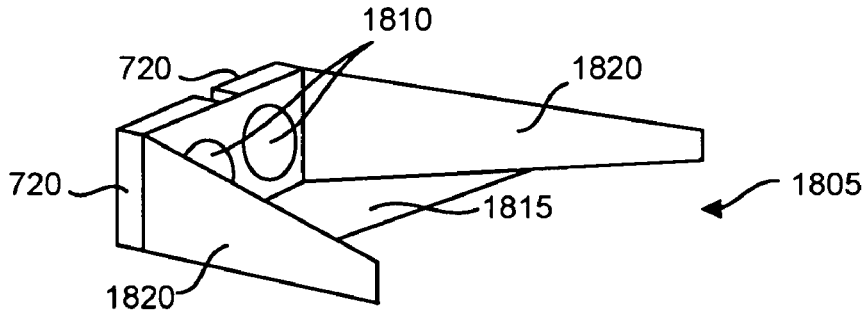
FIG. 19 is a perspective view of a skimmer dredging head assembly, according to an embodiment of the invention.

FIG. 19 is a perspective view of a skimmer dredging head assembly, according to an embodiment of the invention. The skimmer assembly in FIG. 19 includes a channel 1805 with channel walls 1820 that extend beyond the channel floor 1815.

Figure 20:
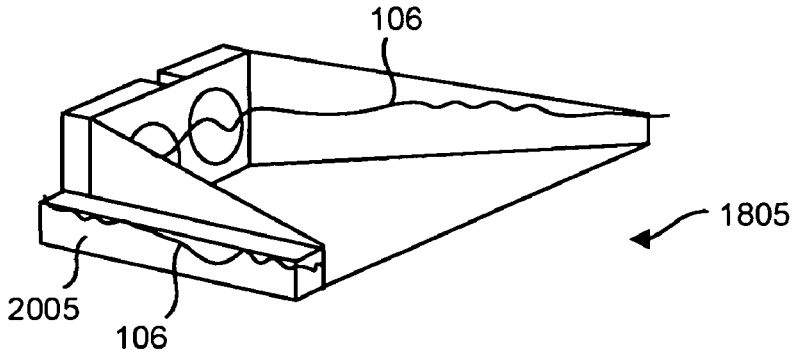
FIG. 20 is a perspective view of a skimmer dredging head assembly, according to an embodiment of the invention.

FIG. 20 is a perspective view of a skimmer dredging head assembly, according to an embodiment of the invention. As illustrated therein, a flotation feature 2005 coupled to the channel 1805 may be used to dispose the skimmer dredge head assembly at a predetermined elevation and attitude with respect to the water surface 106.

It will be apparent to those skilled in the art that modifications and variations can be made without deviating from the spirit or scope of the invention. For example, alternative features described herein could be combined in ways not explicitly illustrated or disclosed. Thus, it is intended that the present invention cover any such modifications and variations of this invention provided they come within the scope of the appended claims and their equivalents.

I claim:

1. A dredging apparatus comprising:

a hull;

a boom coupled to the hull adjacent to an aft end of the boom;

a winch coupled to the hull;

a mast movably coupled to the boom and movably coupled to the hull, the mast having a pulley;

a cable coupled to the winch, movably coupled to the pulley, and further coupled adjacent to a fore end of the boom; and a ram coupled to the hull and the boom, the dredging apparatus thus configured to raise and lower the boom using at least one of the winch and the ram.

2. The dredging apparatus of claim 1, wherein the hull includes at least one pontoon.

3. The dredging apparatus of claim 1, wherein the boom is movably coupled to the hull adjacent to the aft end of the boom via a first pivot joint.

4. The dredging apparatus of claim 3, wherein the boom includes a second pivot joint, the second pivot joint being disposed between a point where the mast is coupled to the boom and the fore end of the boom.

5. The dredging apparatus of claim 3, wherein the boom includes a second pivot joint, the second pivot joint including a lock configured to prevent an angle between a fore boom section and an aft boom section from exceeding 180 degrees.

6. The dredging apparatus of claim 1, wherein the mast is movably coupled to the hull via a skid plate.

7. The dredging apparatus of claim 1, further comprising a wheel assembly affixed to the boom at a location adjacent to the fore end of the boom.

8. The dredging apparatus of claim 1, further comprising a dredging head assembly coupled to the fore end of the boom, the dredging head assembly including at least one suction pump.

9. The dredging apparatus of claim 8, the dredging head assembly further including at least one hydraulic motor coupled to the at least one suction pump.

10. The dredging apparatus of claim 9, further comprising:

an engine coupled to the hull; and a hydraulic pump coupled to the hull, the engine, and the at least one hydraulic motor.

11. The dredging apparatus of claim 10, further comprising a gear box coupled between the engine and the hydraulic pump, the gear box including a centrifugal clutch such that the engine drives the hydraulic pump only above a predetermined rotational speed.

12. The dredging apparatus of claim 8, the dredging head assembly further including a beater bar assembly, the beater bar assembly having:

a beater bar motor;

a beater bar coupled to the beater bar motor; and a plurality of flexible tines, each of the plurality of flexible tines coupled to the beater bar, the beater bar assembly configured such that when the beater bar motor is activated, the beater bar rotates about its longitudinal axis.

13. The dredging apparatus of claim 8, the dredging head assembly further including:

an intake wall coupled to the suction pump;

a vacuum port disposed in the intake wall;

a vacuum hose configured to couple to the vacuum port; and a removable pan configured to couple to the intake wall, the dredging head assembly configured to operate in a first mode when the removable pan is coupled to the intake wall and the vacuum hose is coupled to the vacuum port, the dredging head assembly configured to operate in a second mode when the removable pan is not coupled to the intake wall and the vacuum hose is not coupled to the vacuum port.

14. The dredging apparatus of claim 13, the dredging head assembly further including a pressure relief valve coupled to the intake wall, the pressure relief valve configured to open at a predetermined negative pressure.

15. The dredging apparatus of claim 8, the dredging head assembly further including:

a drive motor;

a drive shaft; and at least one wheel assembly coupled to the drive shaft such that the dredging head assembly is configured to self-propel.

16. A dredging head assembly comprising:

a frame;

a suction pump coupled to the frame;

an intake wall coupled to the suction pump;

a vacuum port disposed in the intake wall;

a vacuum hose configured to couple to the vacuum port;

a pressure relief valve (PRV) disposed in the intake wall, the PRV configured to open at a predetermined negative pressure; and a removable pan configured to connect directly to the intake wall, an enclosed intake chamber being formed when the removable an is connected directly to the intake wall, the dredging head assembly configured to operate in a first mode when the removable pan is connected directly to the intake wall and the vacuum hose is coupled to the vacuum port, the dredging head assembly configured to operate in a second mode when the removable pan is not connected directly to the intake wall and the vacuum hose is not coupled to the vacuum port.

* * * * *